United States Patent [19]

Yorioka et al.

[11] 4,233,946

[45] Nov. 18, 1980

[54] EXHAUST GAS RECIRCULATION SYSTEM

[75] Inventors: Keigo Yorioka, Ohbu; Mikio Minoura, Nagoya, both of Japan

[73] Assignee: Aisan Industry Co., Ltd., Aichi, Japan

[21] Appl. No.: 28,765

[22] Filed: Apr. 9, 1979

[30] Foreign Application Priority Data

Apr. 25, 1978 [JP] Japan ..... 53-48830

[51] Int. Cl.[3] ..... F02M 25/06

[52] U.S. Cl. ..... 123/568

[58] Field of Search ..... 123/119 A

[56] References Cited

U.S. PATENT DOCUMENTS 4,142,491 3/1979 Hibino et al. ..... 123/119 A 4,151,819 5/1979 Inada et al. ..... 123/119 A

*Primary Examiner*—Wendell E. Burns

[57] ABSTRACT

An exhaust gas recirculation system for cleaning exhaust gas from an internal combustion engine is provided in which a variable constriction is provided between an intake pipe and a pressure control valve in operative connection to a throttle valve in the carburetor and the pressure differential across said variable constriction is maintained constant to keep off any influence of the exhaust gas pressure while the ratio of the exhaust gas flow rate to the air intake into the engine is varied in correspondence to the intake pipe negative pressure. This exhaust gas recirculation system can be adapted to a fuel injection type intake system as well as other intake systems provided with an air valve for regulating air intake or having no venturi constriction such as employed in an SU type carburetor.

1 Claim, 8 Drawing Figures

EXHAUST GAS RECIRCULATION SYSTEM

FIELD OF THE INVENTION

This invention relates to an improvement in the exhaust gas recirculation system for cleaning exhaust gas from an internal combustion engine.

BACKGROUND OF THE INVENTION

In the exhaust gas recirculation systems, it is of paramount importance to properly set the ratio of the flow rate of exhaust gas to be recirculated into the intake system to the amount of air taken into the engine.

It is known that changing the exhaust gas flow rate-/air intake ratio (hereinafter referred to as EGR/AI ratio) according to the intake pipe negative pressure is a very effective method, and there are available some systems such as mentioned below for embodying such method: System A in which a variable constriction is provided between the exhaust pipe and pressure control valve and the pressure in a pressure chamber formed between said variable constriction and pressure control valve is maintained constant; System B in which a fixed constriction is provided between the exhaust pipe and pressure control valve and the pressure in a pressure chamber formed between said pressure control valve and fixed constriction is varied in correspondence to the intake pipe negative pressure; System C in which the pressure differential across the fixed constriction provided either upstream or downstream of the pressure control valve is proportioned to the pressure given by the product of the venturi pressure and the value determined according to the intake pipe negative pressure. In the said systems A and B, however, the unstable exhaust pressure is used for determining the EGR/AI ratio, so that in case the exhaust pressure in the low-load area is small and unstable, it is difficult to maintain the EGR-/AI ratio controlling precision. On the other hand, system C is unstable in the engines other than those using a carburetor provided with a fixed venturi.

SUMMARY OF THE INVENTION

This invention is to provide an exhaust gas recirculation system in which a variable constriction is provided between an intake pipe and a pressure control valve in operative connection to a throttle valve in the carburetor and the pressure differential across said variable constriction is maintained constant to keep off any influence of exhaust gas pressure while the EGR/AI ratio is varied in accordance with the intake pipe negative pressure. This exhaust gas recirculation system can be adapted to a fuel injection type intake system as well as other intake systems such as one in which an air valve is provided upstream of the throttle valve and the differential pressure across said air valve is controlled to detect the air intake or one which uses no venturi constriction such as employed in an SU type carburetor.

DESCRIPTION OF THE PREFERRED EMBODIMENTS

Figure 1:
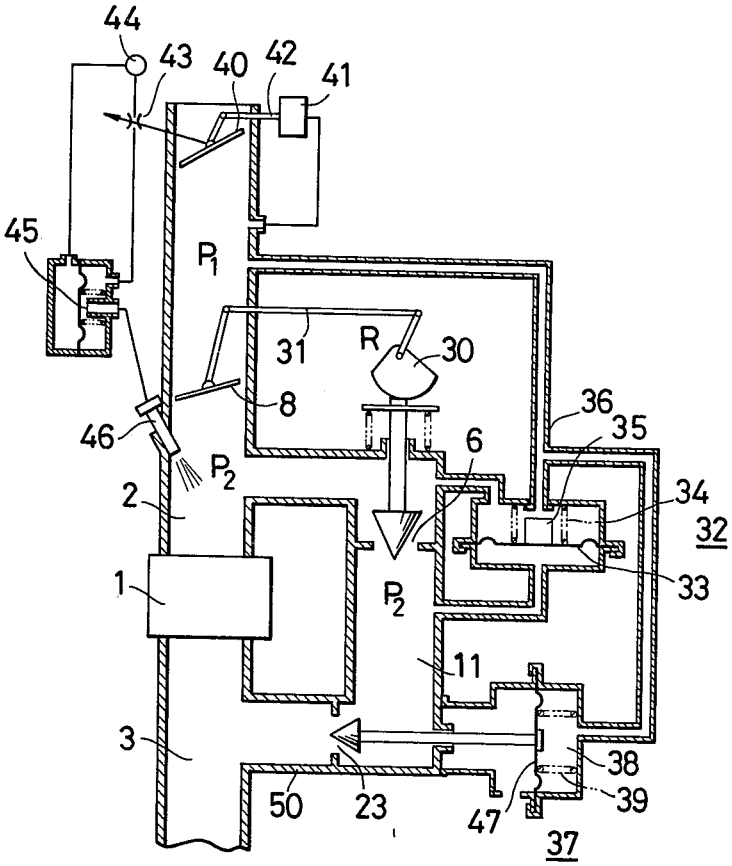
FIG. 1 is a schematic vertical sectional view showing a first embodiment of this invention.

Referring first to FIG. 1, there is shown a first embodiment of this invention. In the drawing, numeral 1 indicates an engine, 2 an intake pipe, and 3 an exhaust pipe. Provided between said both pipes 2 and 3 is an exhaust recirculation passage which extends out from the exhaust pipe 3, passes through a pressure control valve 23, a pressure chamber 11 and a variable throttle or constriction 6 and connects into a portion of the intake pipe 2 located between the throttle valve 8 and engine 1. The variable constriction 6 varies in its opening area in accordance with the turn of a cam 30 which is connected by a link 31 to the throttle valve 8 in the intake pipe so that the opening area of said variable constriction 6 has a given relation to that of the throttle valve 8. A pressure sensor 32 senses the pressure difference between the intake pipe 2 and pressure chamber 11 by a pressure sensing member 33, and when such pressure difference exceeds the value P1 determined by the mounting load of a spring 34 pressed against said pressure sensing member 33 and the effective area thereof, the valve 35 secured to said pressure sensing member is closed. Said valve 35 stays open when said pressure difference is below P1. One end of the passage opened and closed by said valve 35 leads into the intake pipe 2 while the other end is connected through a constriction 36 into a part of the intake passage located upstream of the throttle valve 8 and is also connected by a branch line into a diaphragm chamber 38 in an operating unit 37 which operates the pressure control valve 23. This pressure control valve 23 is normally pressed into its closing position by a spring 39, but when the pressure in the diaphragm chamber 38 is reduced, the diaphragm moves back by overwhelming the pressing force of the spring 39 to thereby open said control valve 23. An air valve 40 is provided upstream of the throttle valve 8, said air valve 40 being connected to a driving unit 41 by a link 42 so that the pressure between said air valve 40 and throttle valve 8 is maintained at a constant value Pm. Said air valve 40 is also mechanically linked to a fuel orifice 43 so that the ratio between their respective opening areas is kept constant. Said fuel orifice 43 is located between a high pressure source 44 for fuel and a differential pressure valve 45 for fuel. Said differential pressure valve 45 is adapted to keep constant the pressure difference across said fuel orifice 43 and connected to a discharge valve 46. The driving unit 41 senses the pressure between the air valve 40 and throttle valve 8 and drives the air valve by utilizing the fuel pressure, etc. This driving unit is of a known system and forms no part of the features of this invention, so that no explanation is given here on this unit.

In this embodiment of the invention, the pressure upstream of the throttle valve 8 is maintained constant by a servo mechanism including said air valve 40 and driving unit 41. When the pressure differential across the variable constriction 6 exceeds a given value with rise of pressure on the pressure chamber 11 side, the valve 35 is closed to diminish the negative pressure which has been given to the diaphragm chamber 38 in the operating unit 37 from the intake pipe 2 through said valve 35. On the other hand, pressure in the diaphragm chamber 38 increases as the diaphragm chamber 38 is connected through the constriction 36 to a part upstream of the throttle valve 8 where pressure is higher than in the intake pipe. Accordingly, the variable pressure throttle 23 is constricted to reduce a pressure in the pressure chamber 11, resulting in the decreased pressure differential across the variable constriction 6. Thus, said pressure sensor 32, operating unit 37 and pressure control valve 23 function cooperatively to maintain constant the pressure differential across the variable constriction 6. Also, the opening areas of the throttle valve 8 and variable constriction 6 are mechanically related to each other by means of a link mechanism 31 and a cam 30.

Figure 2:
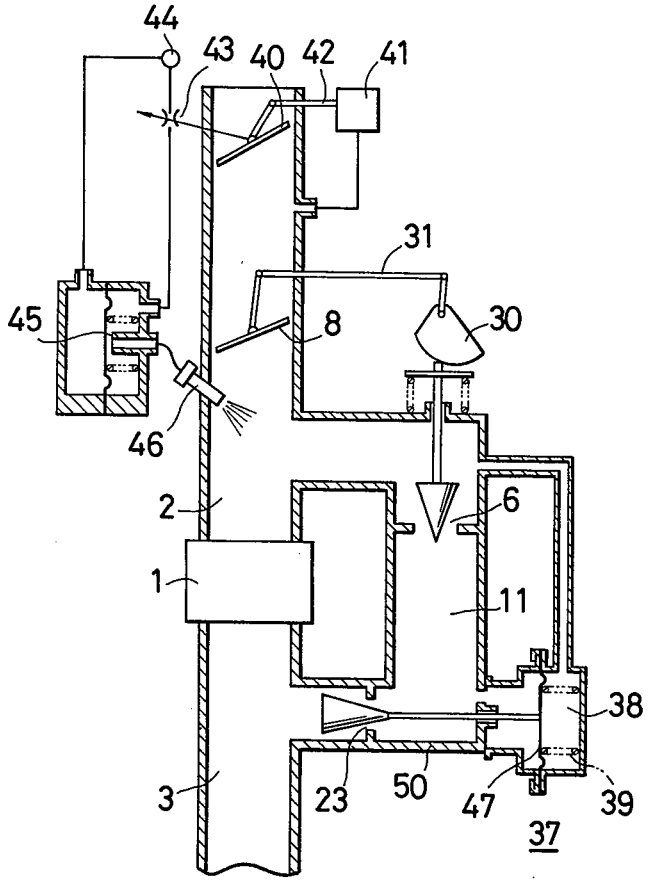
FIG. 2 is a schematic vertical sectional view showing another embodiment of this invention.

Referring now to FIG. 2, there is shown a second embodiment of this invention. The diaphragm chamber 38 in the operating unit 37 which operates the pressure control valve 23 is communicated with the intake pipe 2, and the side of the diaphragm 47 opposite from the diaphragm chamber 38 is connected to the pressure chamber 11. The pressure control valve 23 secured to the diaphragm 47 is kept open under the force of the spring 39 when the pressure difference between the intake pipe 2 and pressure chamber 11 is small, but when such pressure difference exceeds a fixed level, the diaphragm moves back by overwhelming the force of the spring 39 to close the pressure control valve 23.

The parts assigned the same reference numerals as used in the first embodiment have the same construction and function as the corresponding ones of the first embodiment, so that these parts are not explained here again.

In this embodiment, the differential pressure across the variable constriction 6 acts directly to the diaphragm 47 in the operating unit 37, and when such differential pressure exceeds a predetermined level, the diaphragm 47 moves against the force of the spring 30 so as to narrow down the variable constriction 23 to reduce said differential pressure. When such differential pressure becomes lower than the predetermined level, the force acting to the diaphragm 47 is lessened and the force of the spring 30 becomes predominant to enlarge the variable constriction 23 to increase said differential presssure.

Thus, the variable throttle 23, diaphragm 47 and spring 30 function in combination to maintain constant the pressure differential across the variable constriction 6.

Now the operation of the device of this invention is described.

Let it be assumed that the pressure upstream of the throttle valve 8 is P1 and the pressure in the pressure chamber 11 upstream of the variable constriction 6 is P2 while the ratio of the opening area of the throttle valve 8 to that of the variable constriction 6 is R. Since the intake pipe negative pressure Pb acts on the side downstream of these throttling means, the EGR/AI ratio is given by the following formula:

$$EGR/AI \text{ ratio} = \frac{1}{1 + \frac{1}{R}\sqrt{\frac{P1 - Pb}{P2 - Pb}}}$$

Figure 3:
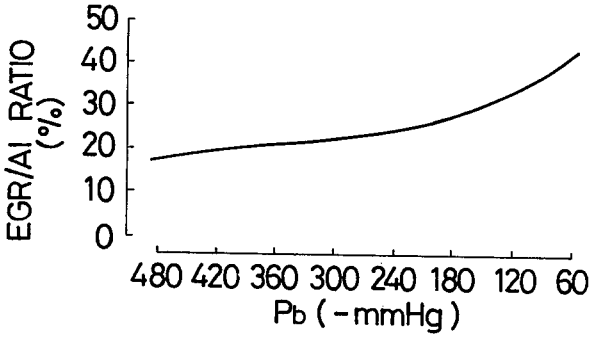
FIG. 3 is a graph showing the EGR/AI ratio-Pb characteristic.
Figure 4:
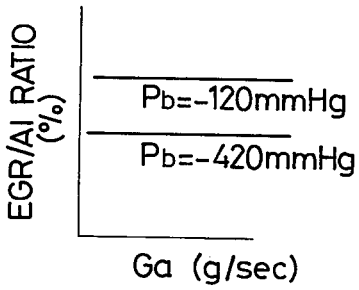
FIG. 4 is a graph showing the EGR/AI ratio-Ga characteristic.
Figure 5:
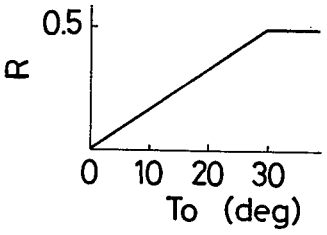
FIG. 5 is a graph showing the R-throttle opening characteristic.
Figure 6:
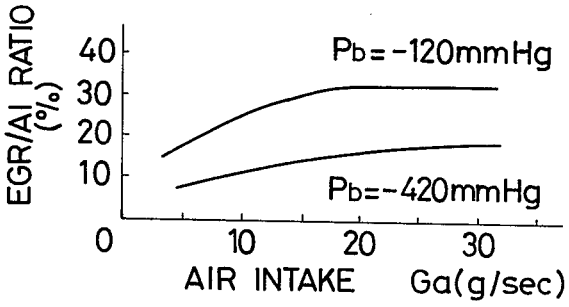
FIG. 6 is a graph showing the EGR/AI ratio-Ga characteristic.

In the embodiments shown in FIGS. 1 and 2, since P1 is constant and P2−Pb is also maintained constant, the EGR/AI ratio is a function of R and Pb. If it is here assumed that P1=−20 mm Hg, R=0.5 and P2−Pb=100 mm Hg, then the relation between the EGR/AI ratio and intake pipe negative pressure Pb may be diagrammatically expressed as shown in FIG. 3, while the relation between said ratio and air intake may be expressed as in FIG. 4. Also, if it is assumed that P1=−20 mm Hg, P2−Pb=100 mm Hg and R has the relation of FIG. 5 with the throttle valve opening, then the relation among EGR/AI ratio, Pb and air intake Ga may be diagrammatized as in FIG. 6.

Figure 7:
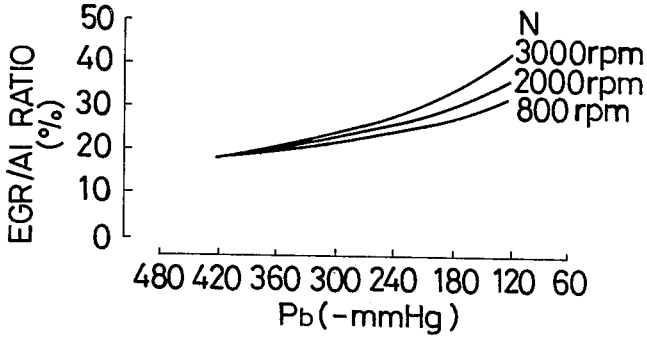
FIG. 7 is a graph showing the EGR/AI ratio-Pb characteristic.
Figure 8:
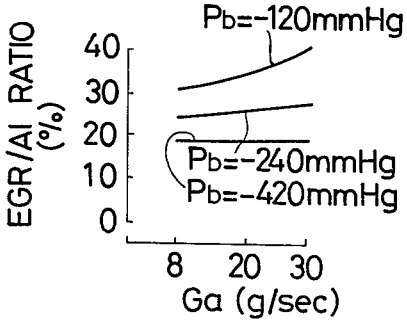
FIG. 8 is a graph showing the EGR/AI ratio-Ga characteristic.

In case a normal fixed venturi type carburetor is used unlike the embodiments shown in FIGS. 1 and 2, the pressure P1 upstream of the throttle valve is not constant but increases proportionally to the air intake Ga. In this case, if it is assumed that R=0.5 and P2−Pb=100 mm Hg, the relation among EGR/AI ratio, Pb and Ga may be expressed as seen in FIGS. 7 and 8. There is noted a tendency of increase of the EGR/AI ratio in the high engine load region. Such tendency is a desirable, one in this invention.

In the embodiment shown in FIGS. 1 and 2, a link mechanism 31 and a cam 30 are used for maintaining constant the areal ratio between the throttle valve 8 and variable constriction 6, but the object can be easily attained by using other known variation transmission mechanism such as gearing, wire connections, etc.

Also, although a concentric needle valve is employed for the variable constriction in the instant embodiment, it is possible to employ other types of valve such as butterfly valve, rotary valve, etc.

Generally, because of blow-back of exhaust gas from the engine combustion chamber into the intake pipe or remnant of gas in the combustion chamber, the smaller the load and the higher the intake pipe negative pressure, the lower must be the EGR/AI ratio. The relation between the EGR/AI ratio and air intake must conform to the characteristics shown in FIGS. 4, 6 and 8. These characteristics are determined when R, P−Pb and relation between R and Tθ are decided.

What is particularly noteworthy in the just described embodiments of this invention is that no exhaust pressure or venturi pressure in the carburetor is used nor is defined the configuration of the throttle valve for controlling the EGR/AI ratio. This allows adaptation of this invention to not only the ordinary fixed venturi type carburetors but also the SU carburetors, fuel injection systems, carburetors using an AMAL type throttle valve and other exhaust gas treating systems used in combination with various kinds of fuel supply systems.

Another advantage of this invention is improved precision in control of the EGR/AI ratio, particularly in the low-load operation, because there is no need of using unstable exhaust pressure with high pulsation or very slight venturi negative pressure in the carburetor for sensing the air intake into the engine.

It is relatively easy to maintain the ratio of the opening area of the throttle valve to that of the variable constriction because such maintenance can be attained by a mechanical means. Also, maintenance of the pressure differential across the variable constriction can be accomplished by a simple means as such pressure differential may span a relatively wide range.

As described above, it is possible with this invention to control the EGR/AI ratio at high precision by a very simple method which merely involves control of the ratio of the opening area of the throttle valve to that of the variable constriction and control of the pressure differential across the variable constriction, almost independently of the intake and exhaust systems of the engine.

What is claimed is:

1. An exhaust gas recirculation system comprising an exhaust gas recirculating passage connecting the exhaust pipe and a portion of the intake pipe located downstream of the throttle valve, a pressure control valve provided in said passage, a variable constriction provided between said pressure control valve and intake pipe in operative connection to said throttle valve, and a pressure control valve operating means adapted to detect the pressure differential across said variable constriction and operat said pressure control valve in conformity to the detected pressure differential whereby the pressure differential across said variable constriction is maintained constant regardless of the opening of said variable constriction.

* * * * *